United States Patent [19]

Von Hein

[11] 4,090,701

[45] May 23, 1978

[54] CUTTING DEVICE FOR A FOLDING APPARATUS OF A ROTARY PRINTING MACHINE

[75] Inventor: Eduard Von Hein, Bern, Switzerland

[73] Assignee: Maschinenfabrik Wifag, Bern, Switzerland

[21] Appl. No.: 730,237

[22] Filed: Oct. 6, 1976

[30] Foreign Application Priority Data

Oct. 27, 1975 Sweden ..... 7511998

[51] Int. Cl.[2] ..... B41F 13/56

[52] U.S. Cl. ..... 270/21; 270/76; 83/344

[58] Field of Search ..... 270/21, 70–77; 83/344–345, 530; 101/226–227, 224

[56] References Cited

U.S. PATENT DOCUMENTS

| | | | |
|---|---|---|---|
| 660,343 | 10/1900 | Spalckhaver | 270/76 |
| 1,985,917 | 1/1935 | Crafts | 270/77 |
| 2,814,484 | 11/1957 | Stobb | 270/71 |

*Primary Examiner*—Ernest T. Wright, Jr.
*Assistant Examiner*—A. Heinz
*Attorney, Agent, or Firm*—Ostrolenk, Faber, Gerb & Soffen

[57] ABSTRACT

A cutting device for a folding apparatus of a rotary printing machine: a folding cylinder which delivers printed product to folding rollers, a cutting cylinder having means to cut the printed product and means to press the printed product against the folding cylinder until the time for release of the printed product; means for moving the axis of the cutting cylinder around the axis of the folding cylinder thereby to adjust the release point of the means that presses the product against the folding cylinder.

13 Claims, 2 Drawing Figures

CUTTING DEVICE FOR A FOLDING APPARATUS OF A ROTARY PRINTING MACHINE

FIELD OF THE INVENTION

The invention relates to a cutting device for a folding apparatus of a rotary printing machine and particularly relates to a rotating cutter blade cylinder for cutting the paper web transversely to the traveling direction of the web.

BACKGROUND OF THE INVENTION

Rotating cutter blade cylinders in the folding apparatus of rotary printing machines are well known. They are all disposed at a particular angle to the folding rollers. As a result, the presser rails on the cutter cylinder always contact the folding apparatus folder cylinder at a particular location around that cylinder. The cut sheets of printed products should be released by the presser rail on the cutter blade cylinder precisely as the printed product is first gripped by the folding means, i.e. folding rollers.

Because the printed products to be cut and folded have progressively increasing numbers of pages, the disadvantage of previous cutting devices becomes more noticeable. The cut sheets for items having different numbers of pages are released either too early or too late by the presser rail that flanks the cutter blade. Too early release causes the printed products to be released from being gripped shortly prior to their entry into the folding rollers. Too late release causes the printed products to be pulled away by the folding rollers from under the presser rail.

SUMMARY OF THE INVENTION

It is the primary object of the invention to provide a cutting device for a folding apparatus of a rotary printing machine which can adjust for varying numbers of pages and thickness of printed product.

It is an object of the invention to provide a cutting device for a folding apparatus of rotary printing machines, wherein the angle of the cutting device, relative to the folding apparatus, around the rotary printing machine is adjustable in accordance with the number of pages of the printed product.

According to the invention, the rotatable cylinder on which the cutter blade and presser rail are rotated, rotate about an axis that is eccentric to and is adjustable about the center or axis of a folding cylinder of the folding apparatus of the printing machine.

BRIEF DESCRIPTION OF THE DRAWINGS

The invention will now be described by way of example with reference to the accompanying drawings wherein.

DESCRIPTION OF A PREFERRED EMBODIMENT

Figure 1:
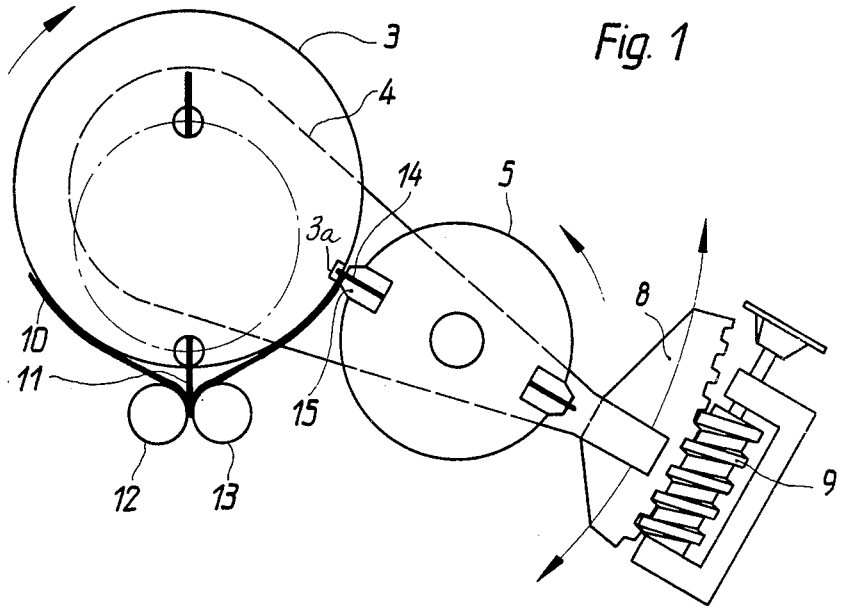
FIG. 1 shows an arrangement of a cutter blade cylinder and folding cylinder of a folding apparatus.
Figure 2:
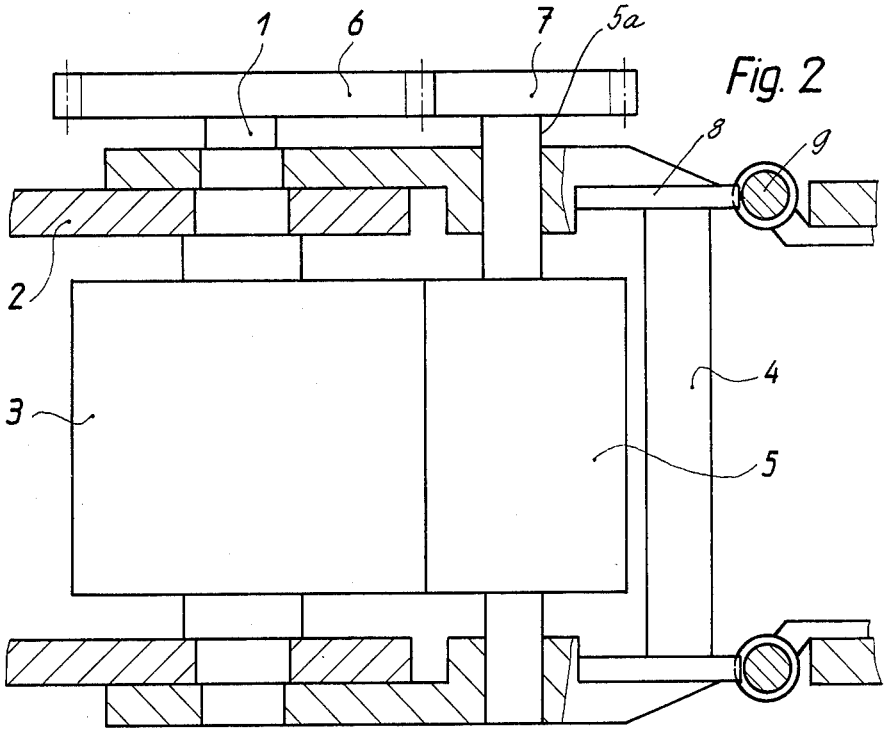
FIG. 2 is a plan view of the arrangement of FIG. 1.

With reference to the drawings, the cutting device includes a stationary machine frame 2. A main folding cylinder shaft 1 passes through and across frame 2 and is nonmovably supported on the frame. A folding cylinder 3 is rotatably mounted on the shaft 1 in the machine casing 2. On its peripheral surface, cylinder 3 has at least one groove 3*a* defined therein extending across the cylinder for receiving a cutter blade 14 when it aligns with the groove 3*a*. A rocker frame 4 is pivotally mounted on the shaft 1, extends past below described cylinder 1 and ends at below described pinion gear 8.

There is a cutter blade cylinder 5 which is rotatably mounted on its shaft 5*a*. The shaft 5*a* passes through and is supported by bearing holes in the rocker frame 4. On the periphery of cylinder 5 there are a plurality of assemblies comprising a cutter blade 14 and presser rails 15 flanking both of the upstream and downstream sides of blade 14. The blades 14 are rotated with cylinder 5 and they align with and enter a blade receiving groove 3*a* on the periphery of cylinder 3.

The shafts 1 and 5*a* terminate in meshing rotatable gears 6 and 7, respectively, and these gears are, in turn, driven by a standard rotational drive (not shown). The sizes of cylinders 3 and 5 and of their gears 6 and 7 and the locations of blades 14 and grooves 3*a* can be coordinated such that a blade 14 enters a then aligned groove 3*a* as the blade passes by the cylinder 3.

An essential feature of the invention is that the rocker frame 4 is adjustable in its angular orientation around shaft 1 with resulting benefits discussed below. Such adjustment can be accomplished either manually or by means of a motor, by an adjustable device, for example, by at least one worm drive arrangement 8, 9, comprised of a segment gear pinion 8 which meshes with a manually rotated or motor rotated worm 9. The rocker 4 can be moved around shaft 1 into at least two fixable predetermined positions.

A support for folder blades 11 is built into the cylinder 3. The folder blades 11 used with this device, their support and their motion are well known and conventional. Folder blades 11 project as illustrated and as these blades move adjacent to a sheaf of papers to be folded, they project into the sheaf, folding it and pressing it between folding rollers 12, 13.

A pair of folding rollers 12, 13 are nonmovably supported on frame 2 beneath cylinder 3 and beneath a folding blade 11 when it moves to the folding location. Drive means (not shown) rotate rollers 12, 13 in opposite directions so as to draw printed product 10 off cylinder 3 and between rollers 12, 13 and rotate them at a greater peripheral surface speed than the peripheral surface speeds of cylinders 3 and 5 so that the folded product 10 may be rapidly drawn away from cylinder 3 and blade 11.

A multi-sheet printed product 10 to be folded is fed by the folder blade 11 at the folding location to and between rotating folding rollers 12, 13 which guide the printed product 10 away from the folder cylinder 3 at an increased speed in a known manner. The presser rail 15 flanking a cutter blade 14 presses the printed product against the peripheral surface of cylinder 3 and ideally releases the trailing end of the printed product 10 as soon as the printed product 10 is gripped by the folding rollers 12, 13.

An increase of the number of pages of the printed product 10 has the effect that the presser rail 15 is compressed more and the trailing end of the printed product 10 is thereby retained longer and must be pulled out from under the presser rail 15 by the pull of the folding rollers 12, 13.

If, on the other hand, the number of pages is reduced, the presser rail 15 releases the trailing end of the printed product 10 even before the printed product 10 is gripped by the folding rollers 12, 13 and the printed product may move freely for a short period of time.

The instant of release by the presser rail 15 of the trailing end of the printed product 10 can be adjusted to suit the changed thickness of the printed product 10 by pivoting the rocker frame 4 so that the printed product will be released just when it is first grabbed by the rollers 12 and 13.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A cutting device for a folding apparatus of a rotary printing machine, or the like, comprising:

a folding cylinder which is rotatable about a first axis and which has a periphery which engages a product to be folded for delivering product to be folded to folding means;

folding means next to said folding cylinder for having product to be folded delivered to it from said folding cylinder and for folding the product; said folding means comprising two adjacent rollers near to, but spaced away from, the periphery of said folding cylinder and means on said folding cylinder for urging a product to be folded between said folding means rollers;

a second cylinder next to said folding cylinder and which is rotatable about a second axis; said second cylinder being spaced from said folding means; said second cylinder including a pressing element attached thereto and rotatable therewith to rotate past said folding cylinder; said pressing element being shaped and positioned so as to press a product to be folded against said folding cylinder as said pressing element rotates past said folding cylinder periphery;

cutting means next to said folding cylinder and being movable periodically into engagement with a product to be folded that is then on said folding cylinder periphery for cutting the product;

adjusting means for adjusting the position of said second cylinder around said first axis and with respect to said folding means, thereby to shift the angular location around said folding cylinder at which said pressing element engages said folding cylinder.

2. The cutting device of claim 1, wherein said adjusting means comprise a rocker frame, which is movable with respect to said folding cylinder, and to which said second cylinder is rotatably attached so that said second cylinder moves with said rocker frame.

3. The cutting device of claim 2, further comprising moving means for moving said rocker frame with respect to said first axis.

4. A cutting device for a folding apparatus of a rotary printing machine, or the like, comprising:

a folding cylinder which is rotatable about a first axis and which has a periphery which engages a product to be folded for delivering product to be folded to folding means;

folding means next to said folding cylinder for having product to be folded delivered to it from said folding cylinder and for folding the product;

a second cylinder next to said folding cylinder and which is rotatable about a second axis; said second cylinder being spaced from said folding means; said second cylinder including a pressing element attached thereto and rotatable therewith to rotate past said folding cylinder; said pressing element being shaped and positioned so as to press a product to be folded against said folding cylinder as said pressing element rotates past said folding cylinder periphery;

cutting means next to said folding cylinder and being movable periodically into engagement with a product to be folded that is then on said folding cylinder periphery for cutting the product;

adjusting means for adjusting the position of said second cylinder around said first axis and with respect to said folding means, thereby to shift the angular location around said folding cylinder at which said pressing element engages said folding cylinder; said adjusting means comprising a rocker frame, which is movable with respect to said folding cylinder, and to which said second cylinder is rotatably attached so that said second cylinder moves with said rocker frame;

moving means for moving said rocker frame with respect to said first axis;

said second cylinder having a periphery; said cutting means comprising a cutting blade projecting from said second cylinder periphery a distance sufficient to cut product on said folding cylinder periphery as said blade rotates past said folding cylinder.

5. A cutting device for a folding apparatus of a rotary printing machine, or the like, comprising:

a folding cylinder which is rotatable about a first axis and which has a periphery which engages a product to be folded for delivering product to be folded to folding means;

folding means next to said folding cylinder for having product to be folded delivered to it from said folding cylinder and for folding the product;

a second cylinder next to said folding cylinder and which is rotatable about a second axis; said second cylinder being spaced from said folding means; said second cylinder including a pressing element attached thereto and rotatable therewith to rotate past said folding cylinder; said pressing element being shaped and positioned so as to press a product to be folded against said folding cylinder as said pressing element rotates past said folding cylinder periphery;

cutting means next to said folding cylinder and being movable periodically into engagement with a product to be foldded that is then on said folding cylinder periphery for cutting the product;

adjusting means for adjusting the position of said second cylinder around said first axis and with respect to said folding means, thereby to shift the angular location around said folding cylinder at which said pressing element engages said folding cylinder; said adjusting means comprising a rocker frame, which is movable with respect to said folding cylinder, and to which said second cylinder is rotatably attached so that said second cylinder moves with said rocker frame; said rocker frame being pivotally attached on said first axis and being movable with respect to said folding cylinder by rotation of said rocker frame about said first axis; moving means for pivoting said rocker frame around said first axis.

6. The cutting device of claim 5, further comprising a support frame for fixedly locating and supporting said first axis.

7. The cutting device of claim 6, wherein said folding means comprise rotatable folding roller means next to said folding cylinder and spaced from said second cylinder for engaging folded product which has passed said second cylinder; said folding cylinder being rotatable in a direction to move folded products from engaging with said second cylinder towards said folding roller means; means for so rotating said folding cylinder.

8. The cutting device of claim 7, wherein said folding roller means are held stationary in position with respect to said folding cylinder as said cutting cylinder moves with respect to said first axis.

9. The cutting device of claim 5, wherein said second cylinder has a periphery; said cutting means comprising a cutting blade projecting from said second cylinder periphery a distance sufficient to cut product on said folding cylinder periphery as said blade rotates past said folding cylinder.

10. The cutting device of claim 9, wherein said blade is adjacent to said pressing element on said second cylinder periphery.

11. The cutting device of claim 9, further comprising a receiving groove in said folding cylinder periphery which is shaped to receive said blade as said second cylinder rotates said blade past said folding cylinder groove, and said blade being of a length to project into said groove as said blade moves past said groove.

12. The cutting device of claim 11, further comprising means connecting and coordinating motion of said second cylinder and said folding cylinder to cause those said cylinders to rotate together, thereby to coordinate the rotation of those said cylinders to coordinate the entry of said blade into said groove.

13. A cutting device for a folding apparatus of a rotary printing machine, or the like, comprising:

first means having a surface of a length sufficient for engaging and which engages a product to be folded for delivering product to be folded to folding means;

folding means next to said surface for having product to be folded delivered to it from said first means and for folding the product;

a cylinder next to said first means and which is rotatable about an axis; said cylinder being spaced from said folding means; said cylinder including a pressing element attached thereto and rotatable therewith to rotate past said first means surface; said pressing element being shaped and positioned so as to press a product to be folded against said surface as said pressing element rotates past said surface;

cutting means next to said surface and being movable periodically into engagement with a product to be folded that is then on said surface for cutting the product;

adjusting means for adjusting the position of said cylinder along the length of said first means surface and with respect to said folding means, thereby to shift the location along the length of said first means surface at which said pressing element engages said surface; said adjusting means comprising a rocker frame, which is movable with respect to the length of said first means surface, and to which said cylinder is rotatably attached so that said cylinder moves along with said rocker frame; said cylinder having a periphery; said cutting means comprising a cutting blade projecting from said cylinder periphery a distance sufficient to cut product on said first means surface as said blade rotates past said first means.

* * * * *